US007879193B2

(12) United States Patent
Quigley

(10) Patent No.: US 7,879,193 B2
(45) Date of Patent: Feb. 1, 2011

(54) STRUCTURED FORMING FABRIC AND METHOD

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 672 days.

(21) Appl. No.: 11/896,842

(22) Filed: Sep. 6, 2007

(65) Prior Publication Data

US 2009/0065166 A1 Mar. 12, 2009

(51) Int. Cl.
*D21F 1/10* (2006.01)
*D03D 11/02* (2006.01)

(52) U.S. Cl. ..... 162/348; 162/116; 162/903; 139/383 A

(58) Field of Classification Search ..... 162/116, 162/348, 902–904; 139/383 A, 383 AA, 139/425 A
See application file for complete search history.

(56) References Cited

U.S. PATENT DOCUMENTS 3,867,766 A 2/1975 Wagner
4,224,372 A 9/1980 Romanski
4,239,065 A 12/1980 Trokhan
4,314,589 A 2/1982 Buchanan et al.
4,423,755 A 1/1984 Thompson
4,501,303 A 2/1985 Osterberg
4,564,052 A 1/1986 Borel
4,759,391 A * 7/1988 Waldvogel et al. ..... 139/383 A
4,832,090 A 5/1989 Krenkal et al.
5,101,866 A 4/1992 Quigley
5,151,316 A 9/1992 Dukin et al.
5,152,326 A 10/1992 Vohringer
5,228,482 A * 7/1993 Fleischer ..... 139/383 A
5,324,248 A 6/1994 Quigley
5,343,896 A 9/1994 Schroder et al.
5,429,686 A 7/1995 Chiu et al.
5,437,315 A 8/1995 Ward
5,456,293 A 10/1995 Ostermayer et al.
5,520,225 A * 5/1996 Quigley et al. ..... 139/383 A
5,542,455 A 8/1996 Ostermayer et al.
5,555,917 A 9/1996 Quigley
5,694,980 A 12/1997 Quigley
5,713,397 A 2/1998 Quigley (Continued)

FOREIGN PATENT DOCUMENTS

WO 02/00996 1/2002

(Continued)

OTHER PUBLICATIONS

Applicant also herein submits a co-pending U.S. Appl. No. 11/896,843, Sep. 6, 2007.

(Continued)

*Primary Examiner*—Eric Hug
(74) *Attorney, Agent, or Firm*—Greenblum & Bernstein, P.L.C.

(57) ABSTRACT

Forming fabric for making a bulky web. The fabric includes a machine facing side and a web facing side having pockets formed by warp and weft yarns. The pockets are defined by more than four sides on an upper plane of the web facing side. This Abstract is not intended to define the invention disclosed in the specification, nor intended to limit the scope of the invention in any way.

30 Claims, 5 Drawing Sheets

U.S. PATENT DOCUMENTS

| | | | | |
|---|---|---|---|---|
| 5,731,059 | A | 3/1998 | Smith et al. | |
| 5,806,569 | A * | 9/1998 | Gulya et al. | 139/383 A |
| 5,817,213 | A | 10/1998 | Ostermayer et al. | |
| 5,826,627 | A | 10/1998 | Seabrook et al. | |
| 5,840,411 | A | 11/1998 | Stlljes et al. | |
| 5,853,547 | A | 12/1998 | Ahrens et al. | |
| 5,945,357 | A | 8/1999 | Quigley | |
| 5,967,195 | A | 10/1999 | Ward | |
| 5,988,229 | A | 11/1999 | Quigley | |
| 6,148,869 | A | 11/2000 | Quigley | |
| 6,202,705 | B1 | 3/2001 | Johnson et al. | |
| 6,227,256 | B1 | 5/2001 | Quigley | |
| 6,237,644 | B1 | 5/2001 | Hay et al. | |
| 6,349,749 | B1 | 2/2002 | Quigley | |
| 6,530,398 | B1 | 3/2003 | Westerkamp | |
| 6,546,964 | B1 | 4/2003 | Westerkamp | |
| 6,581,645 | B1 | 6/2003 | Johnson et al. | |
| 6,592,714 | B2 | 7/2003 | Lamb | |
| 6,649,026 | B2 | 11/2003 | Lamb | |
| 6,834,684 | B2 | 12/2004 | Martin et al. | |
| 6,860,299 | B2 | 3/2005 | Kuji | |
| 6,926,043 | B2 | 8/2005 | Quigley et al. | |
| 6,953,065 | B2 | 10/2005 | Martin et al. | |
| 6,959,737 | B2 | 11/2005 | Ward | |
| 6,978,809 | B2 | 12/2005 | Quigley | |
| 7,007,722 | B2 | 3/2006 | Quigley et al. | |
| 7,048,012 | B2 | 5/2006 | Martin et al. | |
| 7,059,357 | B2 | 6/2006 | Ward | |
| 7,059,359 | B2 | 6/2006 | Quigley et al. | |
| 7,585,395 | B2 * | 9/2009 | Quigley et al. | 162/358.4 |
| 2002/0056536 | A1 | 5/2002 | Lamb | |
| 2004/0020621 | A1 | 2/2004 | Heger et al. | |
| 2004/0079434 | A1 | 4/2004 | Martin et al. | |
| 2004/0182465 | A1 | 9/2004 | Ward | |
| 2004/0231745 | A1 | 11/2004 | Quigley et al. | |
| 2004/0238062 | A1 | 12/2004 | Quigley et al. | |
| 2005/0051230 | A1 | 3/2005 | Martin et al. | |
| 2005/0067040 | A1 | 3/2005 | Quigley | |
| 2005/0103397 | A1 | 5/2005 | Quigley et al. | |
| 2005/0139281 | A1 | 6/2005 | Martin et al. | |
| 2005/0167066 | A1 | 8/2005 | Herman et al. | |
| 2006/0009582 | A1 | 1/2006 | Zhang et al. | |
| 2006/0016505 | A1 | 1/2006 | Westerkamp | |
| 2006/0016509 | A1 | 1/2006 | Westerkamp et al. | |
| 2006/0048840 | A1 | 3/2006 | Quigley | |
| 2006/0060321 | A1 | 3/2006 | Quigley et al. | |
| 2006/0063451 | A1 | 3/2006 | Serr et al. | |
| 2006/0085999 | A1 | 4/2006 | Scherb et al. | |
| 2006/0219312 | A1 | 10/2006 | Hay et al. | |
| 2006/0243338 | A1 | 11/2006 | Hawes et al. | |
| 2006/0278294 | A1 | 12/2006 | Quigley | |
| 2007/0006934 | A1 | 1/2007 | Quigley et al. | |
| 2007/0006935 | A1 | 1/2007 | Quigley et al. | |
| 2007/0028996 | A1 | 2/2007 | Quigley | |
| 2007/0215304 | A1 | 9/2007 | Lippi Alves Fernandes et al. | |
| 2007/0240842 | A1 | 10/2007 | Scherb et al. | |
| 2007/0251659 | A1 | 11/2007 | Fernandes et al. | |
| 2007/0251660 | A1 | 11/2007 | Walkenhaus et al. | |
| 2007/0272385 | A1 | 11/2007 | Quigley et al. | |

FOREIGN PATENT DOCUMENTS

| | | |
|---|---|---|
| WO | 2005/03567 | 4/2005 |
| WO | 2005/035867 | 4/2005 |
| WO | 2005/07532 | 8/2005 |
| WO | 2005/075732 | 8/2005 |
| WO | 2005/075737 | 8/2005 |
| WO | 2005075737 | 8/2005 |
| WO | 2006/113818 | 10/2006 |

OTHER PUBLICATIONS

Applicant also herein submits a co-pending U.S. Appl. No. 11/896,847, Sep. 6, 2007.

* cited by examiner

| | | | | | | | | | | |
|---|---|---|---|---|---|---|---|---|---|---|
| | X | X | X | | X | X | | X | X | 10 |
| | X | X | | X | | X | | | | 9 |
| X | | X | X | | X | X | X | | X | 8 |
| X | | | | | X | X | | X | | 7 |
| X | X | | X | X | | X | X | | X | 6 |
| X | | X | | X | | | | | X | 5 |
| X | X | | X | X | X | | X | X | | 4 |
| | | | X | X | | X | | X | | 3 |
| | X | X | | X | X | | X | X | X | 2 |
| X | | X | | | | | X | X | | 1 |
| 1 | 2 | 3 | 4 | 5 | 6 | 7 | 8 | 9 | 10 | |

STRUCTURED FORMING FABRIC AND METHOD

BACKGROUND OF THE INVENTION

1. Field of the Invention

The present invention relates generally to papermaking, and relates more specifically to a structured forming fabrics employed in papermaking. The invention also relates to a structured forming fabric having deep pockets.

2. Discussion of Background Information

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

In a conventional tissue forming machine, the sheet is formed flat. At the press section, 100% of the sheet is pressed and compacted to reach the necessary dryness and the sheet is further dried on a Yankee and hood section. This, however, destroys the sheet quality. The sheet is then creped and wound-up, thereby producing a flat sheet.

In an ATMOS system, a sheet is formed on a structured or molding fabric and the sheet is further sandwiched between the structured or molding fabric and a dewatering fabric. The sheet is dewatered through the dewatering fabric and opposite the molding fabric. The dewatering takes place with air flow and mechanical pressure. The mechanical pressure is created by a permeable belt and the direction of air flow is from the permeable belt to the dewatering fabric. This can occur when the sandwich passes through an extended pressure nip formed by a vacuum roll and the permeable belt. The sheet is then transferred to a Yankee by a press nip. Only about 25% of the sheet is slightly pressed by the Yankee while approximately 75% of the sheet remains unpressed for quality. The sheet is dried by a Yankee/Hood dryer arrangement and then dry creped. In the ATMOS system, one and the same structured fabric is used to carry the sheet from the headbox to the Yankee dryer. Using the ATMOS system, the sheet reaches between about 35 to about 38% dryness after the ATMOS roll, which is almost the same dryness as a conventional press section. However, this advantageously occurs with almost 40 times lower nip pressure and without compacting and destroying sheet quality. Furthermore, a big advantage of the ATMOS system is that it utilizes a permeable belt which is highly tensioned, e.g., about 60 kN/m. This belt enhances the contact points and intimacy for maximum vacuum dewatering. Additionally, the belt nip is more than 20 times longer than a conventional press and utilizes air flow through the nip, which is not the case on a conventional press system.

Actual results from trials using an ATMOS system have found that the caliper and bulk of the sheet is 30% higher than the conventional through air drying (TAD) formed towel fabrics. Absorbency capacity is also 30% higher than with conventional TAD formed towel fabrics. The results were the same whether one uses 100% virgin pulp up to 100% recycled pulp. Sheets can be produced with basis weight ratios of between 14 to 40 g/m$^2$. The ATMOS system also provides excellent sheet transfer to the Yankee working at 33 to 37% dryness. There is essentially no dryness loss with the ATMOS system since the fabric has square valleys and not square knuckles (peaks). As such, there is no loss of intimacy between the dewatering fabric, the sheet, the molding fabric, and the belt. A key aspect of the ATMOS system is that it forms the sheet on the molding fabric and the same molding fabric carries the sheet from the headbox to the Yankee dryer. This produces a sheet with a uniform and defined pore size for maximum absorbency capacity.

U.S. patent application Ser. No. 11/753,435 filed on May 24, 2007, the disclosure of which is hereby expressly incorporated by reference in its entirety, discloses a structured forming fabric for an ATMOS system. The fabric utilizes an at least three float warp and weft structure which, like the prior art fabrics, is symmetrical in form.

U.S. Pat. No. 5,429,686 to CHIU et al., the disclosure of which is hereby expressly incorporated by reference in its entirety, discloses structured forming fabrics which utilize a load-bearing layer and a sculptured layer. The fabrics utilize impression knuckles to imprint the sheet and increase its surface contour. This document, however, does not create pillows in the sheet for effective dewatering of TAD applications, nor does it teach using the disclosed fabrics on an ATMOS system and/or forming the pillows in the sheet while the sheet is relatively wet and utilizing a hi-tension press nip.

U.S. Pat. No. 6,237,644 to HAY et al., the disclosure of which is hereby expressly incorporated by reference in its entirety, discloses structured forming fabrics which utilize a lattice weave pattern of at least three yarns oriented in both warp and weft directions. The fabric essentially produces shallow craters in distinct patterns. This document, however, does not create deep pockets which have a three-dimensional pattern, nor does it teach using the disclosed fabrics on an ATMOS system and/or forming the pillows in the sheet while the sheet is relatively wet and utilizing a hi-tension press nip.

International Publication No. WO 2005/035867 to LAFOND et al., the disclosure of which is hereby expressly incorporated by reference in its entirety, discloses structured forming fabrics which utilize at least two different diameter yarns to impart bulk into a tissue sheet. This document, however, does create deep pockets which have a three-dimensional pattern. Nor does it teach using the disclosed fabrics on an ATMOS system and/or forming the pillows in the sheet while the sheet is relatively wet and utilizing a hi-tension press nip.

U.S. Pat. No. 6,592,714 to LAMB, the disclosure of which is hereby expressly incorporated by reference in its entirety, discloses structured forming fabrics which utilize deep pockets and a measurement system. However, it is not apparent that the disclosed measurement system is replicatable. Furthermore, LAMB relies on the aspect ratio of the weave design to achieve the deep pockets. This document also does not teach using the disclosed fabrics on an ATMOS system and/or forming the pillows in the sheet while the sheet is relatively wet and utilizing a hi-tension press nip.

U.S. Pat. No. 6,649,026 to LAMB, the disclosure of which is hereby expressly incorporated by reference in its entirety, discloses structured forming fabrics which utilize pockets based on five-shaft designs and with a float of three yarns in both warp and weft (or variations thereof). The fabric is then sanded. However, LAMB does not teach an asymmetrical weave pattern and/or weave designs which have pockets of more than four sides. This document also does not teach using the disclosed fabrics on an ATMOS system and/or forming the pillows in the sheet while the sheet is relatively wet and utilizing a hi-tension press nip.

International Publication No. WO 2006/113818 to KROLL et al., the disclosure of which is hereby expressly incorporated by reference in its entirety, discloses structured forming fabrics which utilize a series of two alternating deep pockets for applications in TAD. However, KROLL does not teach to utilize one consistent sized pocket in order to provide effective and consistent dewatering and would not produce a regular sheet finish on the finished product. KROLL also does not teach an asymmetrical weave pattern and/or weave designs which have pockets of more than four sides. This document also does not teach using the disclosed fabrics on an ATMOS system and/or forming the pillows in the sheet while the sheet is relatively wet and utilizing a hi-tension press nip.

International Publication No. WO2005/075737 to HERMAN et al. and U.S. patent application Ser. No. 11/380,826 filed on Apr. 28, 2006, the disclosure of which are hereby expressly incorporated by reference in their entireties, disclose structured molding fabrics for an ATMOS system which can create a more three-dimensionally oriented sheet. These documents, however, do not teach, among other things, the deep pock weaves according to the invention.

International Publication No. WO 2005/075732 to SCHERB et al., the disclosure of which is hereby expressly incorporated by reference in its entirety, discloses a belt press utilizing a permeable belt in a paper machine which manufactures tissue or toweling. According to this document, the web is dried in a more efficient manner than has been the case in prior art machines such as TAD machines. The formed web is passed through similarly open fabrics and hot air is blown from one side of the sheet through the web to the other side of the sheet. A dewatering fabric is also utilized. Such an arrangement places great demands on the forming fabric because the pressure applied belt press and hot air is blown through the web in the belt press. However, this document does not teach, among other things, the deep pock weaves according to the invention.

The above-noted conventional fabrics limit the amount of bulk that can be built into the sheet being formed due to the fact that they have shallow depth pockets compared to the instant invention. Furthermore, the pockets of the conventional fabrics are merely extensions of the contact areas on the warp and weft yarns.

SUMMARY OF THE INVENTION

According to one non-limiting aspect of the invention, there is provided a structured fabric having a warp and weft structure that is asymmetrical in form. By breaking up the pattern, the invention provides offset pillows and creates a shape that is to some extent diagonal. This has can improve the performance of the system in terms of on-machine drying efficiency.

According to another non-limiting aspect of the invention, there is provided a structured fabric that provides increased caliper, bulk, and absorbency in tissue and toweling.

According to another non-limiting aspect of the invention, there is provided various weave designs/configurations wherein warp impressions are utilized to provide deep pockets at optimum frequency compared to conventional fabrics. The pockets are deeper than those of conventional fabrics because they have bottoms which are arranged on a plane lower than the contact level which borders the pocket on two sides. The floors or bottoms of the pockets can also be formed by a plain weave.

According to another non-limiting aspect of the invention, the weave designs/configurations of the invention can be used on conventional TAD systems, on an ATMOS system, on an E-TAD (i.e., a proprietary process of Georgia-Pacific) system, and/or on Metso systems.

According to another non-limiting aspect of the invention, the forming fabric of the invention is used on an ATMOS system. By dewatering from the belt press belt of the ATMOS system towards the web, structured fabric and the dewatering belt, contact area at the Yankee is enhanced and a higher dryer efficiency results at the Yankee. This is because the surface of the web which contacts the dewatering belt is the same surface which contacts the Yankee. Using such a configuration results in, among other things, a higher contact area between the paper web and the Yankee cylinder than is normally achieved using a through air drying (TAD) system.

According to another non-limiting aspect of the invention, the weave designs/configurations of the invention can utilize shaped yarns, as well as a wide range of meshes, counts, permeabilities, yarn diameters and number of pockets per square inch as will be specified herein.

According to another non-limiting aspect of the invention, there is provided a forming fabric for the manufacture of bulky tissue and/or toweling wherein the fabric comprises a plurality of substantially equally sized pockets formed by having a warp and weft interchange such that the pockets have more than four sides.

According to another non-limiting aspect of the invention, there is provided a forming fabric for the manufacture of bulky tissue and/or toweling wherein the fabric comprises a plurality of substantially equally sized non-square pockets formed by having a minimum of two planes of warp and weft interchange such that in the upper plane of the fabric, the pockets are surrounded by warp and weft yarns, and the bottom plane can, in particular, be formed by three warp yarns and at least three weft yarns.

According to another non-limiting aspect of the invention, there is provided a forming fabric for the manufacture of bulky tissue and/or toweling wherein the fabric produces a tissue or towel sheet with an improved elongated surface shape for the pillows on the sheet, while also maintaining a standard pocket size thereby providing improved machine performance.

According to another non-limiting aspect of the invention, there is provided a forming fabric for the manufacture of bulky tissue and/or toweling wherein the fabric has deep pockets formed by a bottom plane having three warp yarns and four or five weft yarns.

According to another non-limiting embodiment, the fabric utilizes a regular yet offset pattern in the web in order to improve dewatering and drying.

The invention also provides for a twin wire ATMOS system which utilizes the belt press belt disclosed in U.S. patent application Ser. No. 11/276,789 filed on Mar. 14, 2006. The disclosure of this US patent application is hereby expressly incorporated by reference in its entirety.

The invention additionally also provides for a twin wire ATMOS system which utilizes the dewatering fabric disclosed in U.S. patent application Ser. No. 11/380,835 filed Apr. 28, 2006. The disclosure of this US patent application is hereby expressly incorporated by reference in its entirety.

The invention also provides for a dewatering system for dewatering a web wherein the system includes a twin wire former, a belt press, and a structured fabric comprising a paper web facing side, guided over a support surface and through the belt press. The structured fabric runs at a slower speed than a wire of the twin wire former.

The structured fabric may be a permeability value of between approximately 100 cfm and approximately 1200 cfm, a paper surface contact area of between approximately 5% and approximately 70% when not under pressure and tension, and an open area of between approximately 10% and approximately 90%.

The structured fabric may comprise one of a single material, a monofilament material, a multifilament material, and two or more different materials.

The structured fabric may be resistant to at least one of hydrolysis and temperatures which exceed 100 degrees C.

The structured fabric may be an endless belt that is at least one of pre-seamed and has its ends joined on a machine which utilizes the belt press.

The web may be at least one of a tissue web, a hygiene web, and a towel web.

The invention also provides for a method of subjecting a fibrous web to pressing in a paper machine using any of the systems described herein, wherein the method comprises forming the fibrous web in the twin wire former and applying pressure to the structured fabric and the fibrous web in the belt press while the web is arranged on the structured forming fabric.

According to another non-limiting aspect of the invention, there is provided a forming fabric for making a bulky web, wherein the fabric comprises a machine facing side and a web facing side comprising pockets formed by warp and weft yarns. The pockets are defined by more than four sides on an upper plane of the web facing side.

The bulky web may comprise at least one of a tissue web, a hygiene web, and a towel web. The pockets may be substantially equally sized pockets. A bottom of the pockets may be formed by a plain weave of the warp and weft yarns. The warp yarns may form warp knuckles that define the upper plane of the fabric. The weft yarns may form weft knuckles that define the upper plane of the fabric. A shape of the pockets may be at least one of non square-shaped, non rectangular-shaped, and six-sided. A bottom of the pockets may be formed by a different number of the warp and the weft yarns. The different number of the warp and the weft yarns may comprise more weft yarns than warp yarns.

The fabric may comprise a warp mesh of about 59, a weft count of about 48, a permeability of approximately 573 cfm, and a caliper of approximately 0.0362 inches. The fabric may comprise one of a single material, a monofilament material, a multifilament material, and two or more different materials. The fabric may be resistant to at least one of hydrolysis and temperatures which exceed 100 degrees C. The fabric may be an endless belt that is at least one of pre-seamed and has its ends joined on a machine which utilizes a belt press. The fabric may be structured and arranged to impart a topographical pattern to a web. The fabric may utilize a pattern repeat of ten warp yarns and ten weft yarns. Three of the warp yarns of the pattern repeat may float over five weft yarns. One of the warp yarns of the pattern repeat may float over weft yarns 4-8 and another of the warp yarns floats over weft yarns 2-6 or 6-10. None of the warp yarns of the pattern repeat may plainly weave with all ten weft yarns. Warp yarns 2, 4, 6, 8 and 10 of the pattern repeat may pass over five weft yarns. Warp yarns 1, 3, 5, 7 and 9 of the pattern repeat may pass over six weft yarns.

The invention also provides for a method of subjecting a web to pressing in a paper machine using the fabric described above, wherein the method comprises forming a web and applying pressure to the fabric and the web. The paper machine may comprise one of a TAD system, an ATMOS system, an E-TAD system, and a Metso system.

The invention also provides for a forming fabric for making a bulky web, comprising a web facing side comprising pockets formed by warp and weft yarns. A bottom of the pockets is formed by a plain weave of the warp and weft yarns. A contact plane of the web facing side comprises warp knuckles. The pockets are defined by more than four sides on the contact plane of the web facing side.

A bottom of the pockets may comprise a different number of the warp and the weft yarns. The different number of the warp and the weft yarns may comprise three warp yarns and more than three weft yarns.

The invention also provides for a forming fabric for making a bulky web, comprising a web facing side comprising pockets formed by warp and weft yarns. A bottom of the pockets is formed a plain weave of the warp and weft yarns. A contact plane of the web facing side comprises warp and weft knuckles. The pockets are defined by more than four sides on the upper plane of the web facing side.

Each pocket may be formed by less warp yarns than weft yarns. Each pocket may be formed by five warp yarns and seven weft yarns.

The invention also provides for a paper making machine fabric comprising a woven fabric having a weave pattern which is regularly repeated over a surface. Weft yarns, warp yarns, and recesses or pockets open upwardly to a paper supporting side of the fabric. Zones are spaced over the surface of the fabric. At least one of the warp yarns overlays five of the weft yarns in direct sequence. At least one of the weft yarns overlays four of the warp yarns in direct sequence.

The invention also provides for a paper making machine fabric comprising a woven fabric having a weave pattern repeating over a surface. A pattern square for the repeating pattern contains ten warp yarns and ten weft yarns. Warp yarn 1 extends over weft yarn 1, under weft yarns 2-3, over weft yarns 4-8 and under weft yarns 9-10. Warp yarn 2 extends under weft yarn 1, over weft yarn 2, under weft yarn 3, over weft yarn 4, under weft yarn 5, over weft yarn 6, under weft yarns 7-8 and over weft yarns 9-10. Warp yarn 3 extends over weft yarns 1-2, under weft yarns 3-4, over weft yarn 5, under weft yarns 6-7 and over weft yarns 8-10. Warp yarn 4 extends under weft yarns 1-2, over weft yarns 3-4, under weft yarn 5, over weft yarn 6, under weft yarn 7, over weft yarn 8, under weft yarn 9 and over weft yarn 10. Warp yarn 5 extends under weft yarn 1, over weft yarns 2-6, under weft yarns 7-8, over weft yarn 9 and under weft yarn 10. Warp yarn 6 extends under weft yarn 1, over weft yarn 2, under weft yarn 3, over weft yarn 4, under weft yarns 5-6, over weft yarns 7-8, under weft yarn 9 and over weft yarn 10. Warp yarn 7 extends under weft yarns 1-2, over weft yarn 3, under weft yarns 4-5 and over weft yarns 6-10. Warp yarn 8 extends over weft yarns 1-2, under weft yarn 3, over weft yarn 4, under weft yarn 5, over weft yarn 6, under weft yarn 7, over weft yarn 8 and under weft yarns 9-10. Warp yarn 9 extends over weft yarns 14, under weft yarns 5-6, over weft yarn 7, under weft yarns 8-9 and over weft yarn 10. Warp yarn 10 extends under weft yarn 1, over weft yarn 2, under weft yarns 34, over weft yarns 5-6, under weft yarn 7, over weft yarn 8, under weft yarn 9 and over weft yarn 10.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The present invention relates to a forming fabric a paper machine, a former for manufacturing premium tissue and toweling, and also to a former which utilizes the forming fabric and a belt press in a paper machine. The present invention relates to a twin wire former for manufacturing premium issue and toweling which utilizes the forming fabric and a belt press in a paper machine. The system of the invention is capable of producing premium tissue or toweling with a quality similar to a through-air drying (TAD) but with up to a 40% cost savings.

The present invention also relates to a twin wire former ATMOS system which utilizes a structured fabric which has good resistance to pressure and excessive tensile strain forces, and which can withstand wear/hydrolysis effects that are experienced in an ATMOS system. The system also includes a permeable belt for use in a high tension extended nip around a rotating roll or a stationary shoe and/or which is used in a papermaking device/process, and a dewatering fabric for the manufacture of premium tissue or towel grades without utilizing a through-air drying (TAD) system. The fabric has key parameters which include permeability, weight, caliper, and certain compressibility.

Figures 1, 2:
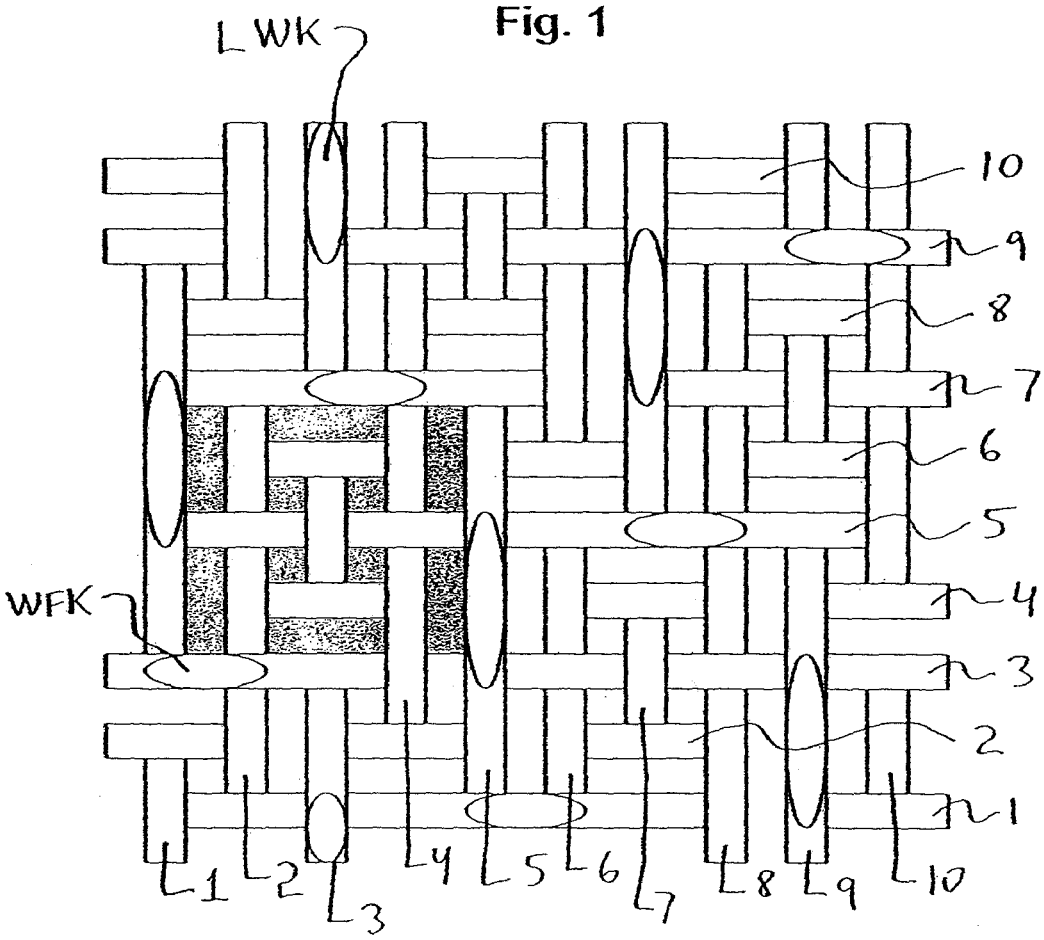
FIG. 1 shows a weave pattern of a top side or paper facing side of one non-limiting embodiment of a forming fabric according to the invention.
FIG. 2 shows a weave pattern repeat of the forming fabric shown in FIG. 1. The pattern repeat includes ten warp threads and ten weft threads. The value "X" indicates locations wherein the warp threads pass over weft threads.

One non-limiting embodiment of the structured fabric of the present invention is illustrated in FIGS. 1-6. FIG. 1 depicts a top pattern view of the top fabric plane or paper side surface of the fabric (i.e., a view of the papermaking surface). The numbers 1-10 shown on the bottom of the pattern identify the warp (machine direction) yarns while the right side numbers 1-10 show the weft (cross-direction) yarns. In FIG. 2, symbol X illustrates locations where warp yarns pass over the weft yarns and empty boxes illustrate locations where warp yarns pass under weft yarns. The area formed between warp yarn 1 and warp yarn 5, and between weft yarn 1 and weft yarn 7, illustrates a pocket area which will form a pillow in a web or sheet. The shaded area indicates a bottom area of a pocket. The upper layer of the fabric defines a pocket shape between three long warp knuckles LWK and three weft knuckles WFK which can be, e.g., substantially six-sided, and/or non rectangular-shaped and non-square (see, e.g., impressions of knuckles on the web depicted in FIG. 6.

By way of non-limiting example, the parameters of the fabric shown in FIG. 1 can have a mesh (number of warp yarns per inch) of 59 and a count (number of weft yarns per inch) of 48. The fabric can have a permeability of about 573 cfm and a caliper of about 0.0362 inches. The embodiment shown in FIG. 1 also results in deep pockets formed in the fabric whose lower plane is formed by three warp yarns (e.g., warp yarns 2-4) and five weft yarns (e.g., weft yarns 2-6, with weft yarns 4-6 forming the very bottom of the pocket).

Figure 3:
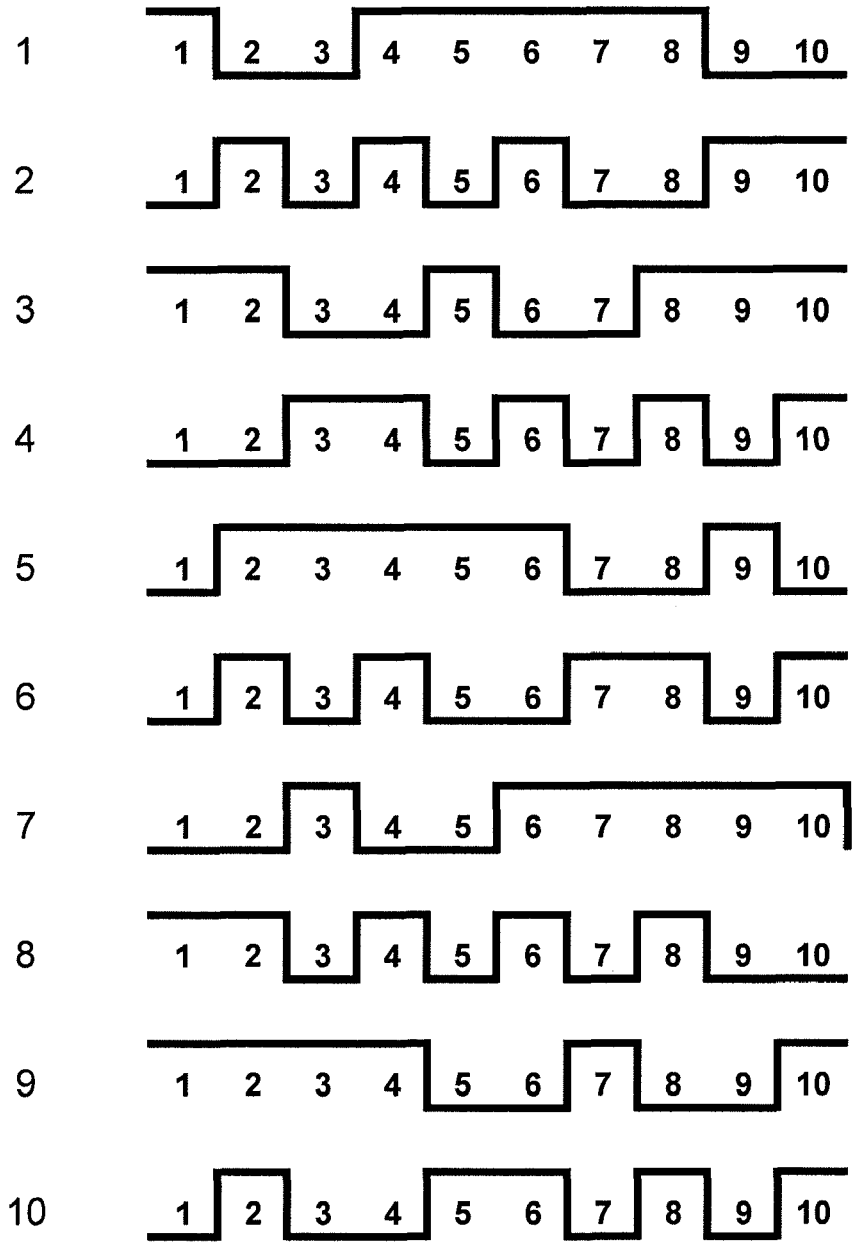
FIG. 3 shows cross-sections of the weave pattern repeat of the forming fabric shown in FIGS. 1 and 2, and illustrates how each of the warp yarns weaves with the weft yarns.

The fabric of FIG. 2 shows a single repeat of the fabric that encompasses 10 warp yarns (yarns 1-10 represented vertically in FIG. 1) and 10 weft yarns (yarns 1-10 represented horizontally in FIG. 1). The fabric cab be a ten shed dsp. FIG. 3 depicts the paths of the warp yarns 1-10 as they weave with the weft yarns 1-10. While FIGS. 2 and 3 only show a single repeat unit of the fabric, those of skill in the art will appreciate that in commercial applications the repeat unit shown in FIGS. 2 and 3 would be repeated many times, in both the warp and weft directions, to form a large fabric suitable for use on a papermaking machine.

As seen in FIG. 3, warp yarn 1 passes over weft yarn 1, then passes under weft yarns 2-3, then floats over weft yarns 4-8, and then passes under weft yarns 9-10. In the area where the warp yarn 1 weaves with, e.g., weft yarns 1-2, this forms part of the plain weave bottom for a pocket. Furthermore, long warp knuckles LWK are formed in the areas where the warp yarn 1 passes over the five weft yarns 5-8. A weft knuckle WFK is formed in the areas where the weft yarn 3 passes over the warp yarn 1.

Warp yarn 2 weaves with weft yarns 1-10 by passing over weft yarns 2, 4, 6, 9 and 10, and by passing under weft yarns 1, 3, 5 and 7-8. That is, warp yarn 2 first passes under weft yarn 1, then over weft yarn 2, then passes under weft yarn 4, then under weft yarn 5, then over weft yarn 6, then under weft yarns 7-8, and then over weft yarns 9-10. In the area where the warp yarn 2 plainly weaves with, e.g., weft yarns 4-6, this forms part of the bottom for a pocket. Weft knuckles WFK are formed in the areas where the weft yarn 3 passes over the warp yarn 2.

Again with reference to FIG. 3, warp yarn 3 weaves with weft yarns 1-10 by passing over weft yarns 1-2, 5 and 8-10, and passing under weft yarns 3-4 and 6-7. That is, warp yarn 3 passes over weft yarns 1-2, then passes under weft yarns 34, then over weft yarn 5, then under weft yarns 6-7, and then over weft yarns 8-10. In the area where the warp yarn 3 plainly weaves with, e.g., weft yarns 4-6, this forms part of the bottom for a pocket. Furthermore, long warp knuckles LWK are formed in the areas where the warp yarn 3 passes over, e.g., weft yarns 1-2 and 8-10. Weft knuckles WFK are formed in the areas where, e.g., weft yarn 7, passes over warp yarn 3.

Warp yarn 4 weaves with weft yarns 1-10 by passing over weft yarns 3-4, 6, 8 and 10, and passing under weft yarns 1, 2, 5, 7 and 9. That is, warp yarn 4 passes under weft yarns 1-2, then passes over weft yarns 3-4, then under weft yarn 5, then passes over weft yarn 6, then passes under weft yarn 7, then passes over weft yarn 8, then passes under weft yarn 9, and then passes over weft yarn 10. In the area where the warp yarn 4 weaves with, e.g., weft yarns 4-6, this forms part of the bottom for a pocket. Weft knuckles WFK are formed in the areas where the weft yarn 7 passes over the warp yarn 4.

Again with reference to FIG. 3, warp yarn 5 weaves with weft yarns 1-10 by passing over weft yarns 2-6 and 9 and by passing under weft yarns 1, 7-8 and 10. That is, warp yarn 5 first passes under weft yarn 1, then floats over weft yarns 2-6, then passes under weft yarns 7-8, then over weft yarn 9, and then under weft yarn 10. In the area where the warp yarn 5 plainly weaves with, e.g., weft yarns 8-10, this forms part of the bottom for a pocket. Long warp knuckles LWK are formed in the areas where the warp yarn 5 passes over the weft yarns 2-6. Weft knuckles WFK are formed in the areas where the weft yarn 1 passes over the warp yarn 5.

Warp yarn 6 weaves with weft yarns 1-10 by passing over weft yarns 2, 4, 7, 8 and 10, and passing under weft yarns 1, 3, 5, 6 and 9. That is, warp yarn 6 passes under weft yarn 1, then over weft yarn 2, then under weft yarn 3, then over weft yarn 4, then passes under weft yarns 5-6, then passes over weft yarns 7-8, then passes under weft yarn 9, and then passes over weft yarn 10. In the area where the warp yarn 6 plainly weaves with, e.g., weft yarns 24, this forms part of the bottom for a pocket. Weft knuckles WFK are formed in the areas where, e.g., weft yarn 1 passes over warp yarn 6.

Again with reference to FIG. 3, warp yarn 7 weaves with weft yarns 1-10 by passing over weft yarns 3 and 6-10 and by passing under weft yarns 1-2 and 4-5. That is, warp yarn 7 first passes under weft yarns 1-2, then passes over weft yarn 3, then passes under weft yarns 4-5, and then over weft yarns 6-10. In the area where the warp yarn 7 plainly weaves with, e.g., weft yarns 2-4, this forms part of the bottom for a pocket. Long warp knuckles LWK are formed in the areas where the warp yarn 5 passes over the weft yarns 6-10. Weft knuckles WFK are formed in the areas where the weft yarn 5 passes over the warp yarn 7.

Warp yarn 8 weaves with weft yarns 1-10 by passing over weft yarns 1-2, 4, 6 and 8, and passing under weft yarns 3, 5, 7, 9 and 10. That is, warp yarn 8 passes over weft yarns 1-2, then passes under weft yarn 3, then over weft yarn 4, then passes under weft yarn 5, then passes over weft yarn 6, then passes under weft yarn 7, then passes over weft yarn 8, and then passes under weft yarns 9-10. In the area where the warp yarn 8 weaves with, e.g., weft yarns 6-8, this forms part of the bottom for a pocket. Weft knuckles WFK are formed in the areas where the weft yarn 5 passes over the warp yarn 8.

Again with reference to FIG. 3, warp yarn 9 weaves with weft yarns 1-10 by passing over weft yarns 14, 7 and 10, and passing under weft yarns 5-6 and 8-9. That is, warp yarn 9 passes over weft yarns 1-4, then passes under weft yarns 5-6, then over weft yarn 7, then under weft yarns 8-9, and then over weft yarn 10. In the area where the warp yarn 9 plainly weaves with, e.g., weft yarns 6-8, this forms part of the bottom for a pocket. Furthermore, long warp knuckles LWK are formed in the areas where the warp yarn 3 passes over, e.g., weft yarns 1-2 and 8-10. Weft knuckles WFK are formed in the areas where, e.g., weft yarn 9, passes over warp yarn 9.

Finally, warp yarn 10 weaves with weft yarns 1-10 by passing over weft yarns 2, 5, 6, 8 and 10, and passing under weft yarns 1, 3, 4, 7 and 9. That is, warp yarn 10 passes under weft yarn 1, then over weft yarn 2, then under weft yarns 3-4, then over weft yarns 5-6, then passes under weft yarn 7, then passes over weft yarn 8, then passes under weft yarn 9, and then passes over weft yarn 10. In the area where the warp yarn 10 plainly weaves with, e.g., weft yarns 6-8, this forms part of the bottom for a pocket. Weft knuckles WFK are formed in the areas where, e.g., weft yarn 9 passes over warp yarn 10.

Figure 4:
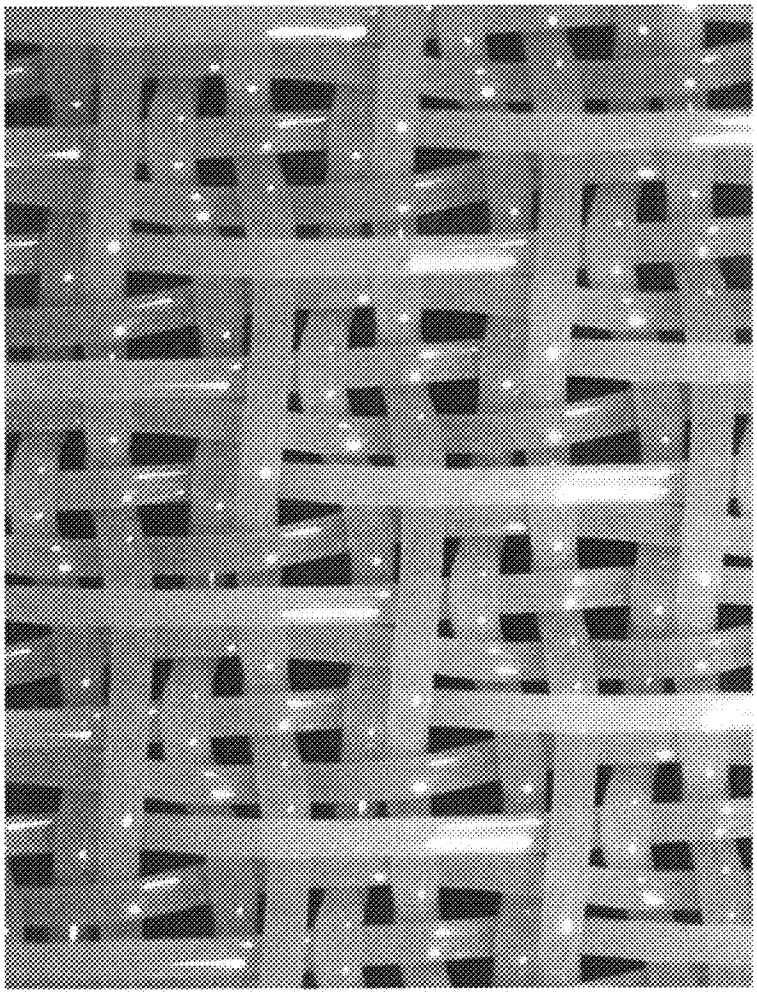
FIG. 4 shows a photograph of a top side or paper facing side of an actual forming fabric utilizing the weave pattern shown in FIG. 1.
Figure 5:
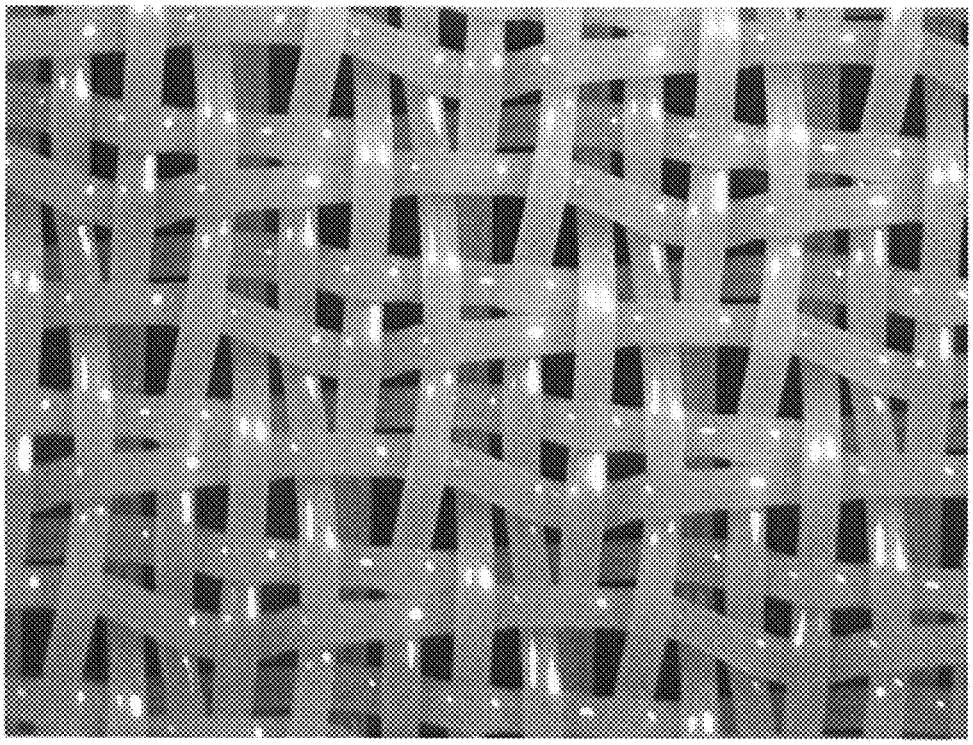
FIG. 5 shows a photograph of a bottom side or machine side of the forming fabric shown in FIG. 4.
Figure 6:
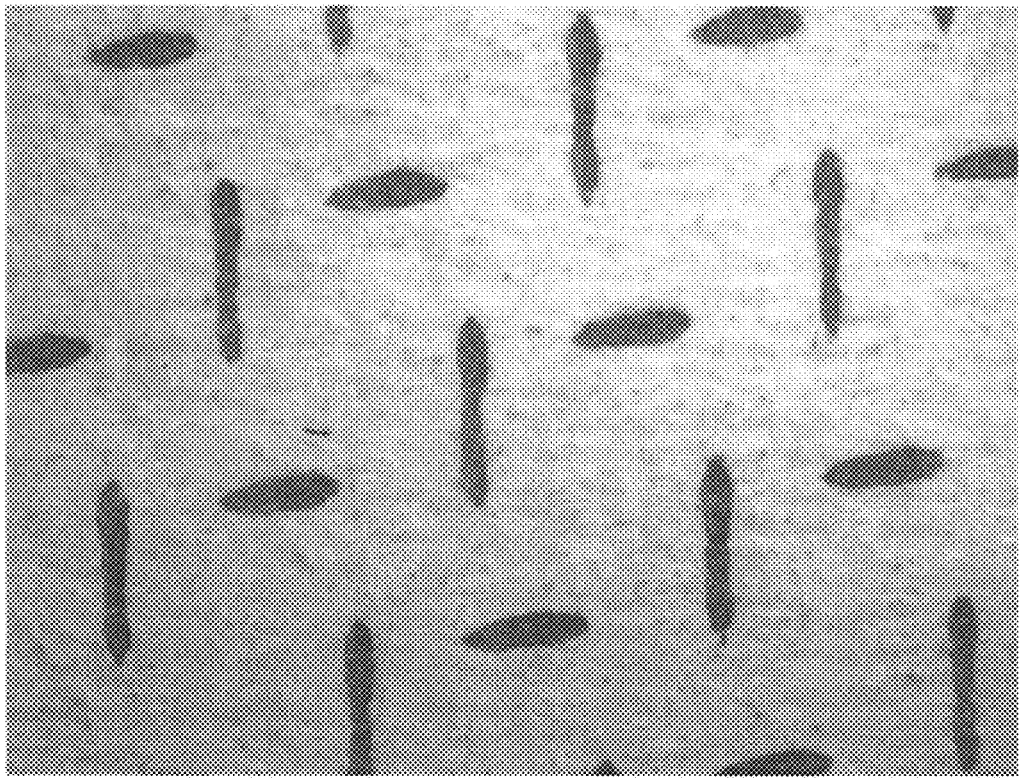
FIG. 6 shows a photograph of impressions which are formed in a sheet in contact with the top side or paper facing side of an actual forming fabric shown in FIG. 4.

FIG. 4 shows a photograph of a top side or paper facing side of an actual forming fabric utilizing the weave pattern shown in FIG. 1. FIG. 5 shows a photograph of a bottom side or machine side of the forming fabric shown in FIG. 4. Finally, FIG. 6 shows a photograph of impressions which are formed in a sheet or web in contact with the top side or paper facing side of an actual forming fabric shown in FIG. 4.

The invention also provides for utilizing any of the herein disclosed fabrics on a machine for making a fibrous web, e.g., a tissue, hygiene paper wed, etc., which can be, e.g., a twin wire ATMOS system for processing a fibrous web. By way of non-limiting example, the ATMOS system can be of the type disclosed in U.S. patent application Ser. No. 11/735,211 filed on Apr. 13, 2007, the disclosure of which is hereby expressly incorporated by reference in its entirety.

The ATMOS system can include a headbox which feeds a suspension to a twin wire former formed by an outer wire, an inner wire and a forming roll. The twin wire former can be of any conventionally known type and can preferably be of the type disclosed in e.g., US Patent Application Publication No. 2006/0085999 (based on U.S. application Ser. No. 11/189,884 filed on Jul. 27, 2005), the disclosure of which is hereby expressly incorporated by reference in its entirety. Once the web is formed by the twin wire former, the web is conveyed by the inner wire to a structured fabric. The web is transferred to the structured fabric from the inner wire using a suction box located at a pick-up area. The web is conveyed by the structured fabric, of the type described above, to and through a pressing arrangement, e.g., formed by a belt press assembly composed of a permeable tension belt and a vacuum roll. A dewatering fabric can also pass over the vacuum roll and through the belt press assembly. The web can be dewatered in an extended belt press nip, e.g., formed by the belt press assembly and the vacuum roll and may then be carried by the structured belt to a Yankee cylinder and hood arrangement, and can then be transferred to the Yankee using a press roll. A steam box and hot air blower arrangement may be arranged within the permeable tension belt and is arranged over a suction zone of the vacuum roll. One or more savealls can be utilized to collect moisture collected from the vacuum roll. The system can also utilize a number of guide rolls for each of the belts/fabrics, an adjusting roll for the dewatering belt, a number of Uhle boxes, a number of shower units, and an additional suction box or pick-up.

The structured fabric can preferably be an endless fabric which transports the web to and from the belt press system, from the twin wire former, and to the Yankee cylinder for final drying. After being transferred from the twin wire former, the web lies in the three-dimensional structure of the fabric, and therefore it is not flat but has also a three-dimensional structure, which produces a high bulky web.

By way of non-limiting example, the structured fabric can be a single or multi-layered woven fabric which can withstand the high pressures, heat, moisture concentrations, and which can achieve a high level of water removal and also mold or emboss the paper web required by the Voith ATMOS paper making process. The fabric should also have a width stability and a suitable high permeability. The fabric should also preferably utilize hydrolysis and/or temperature resistant materials.

The fabric is also preferably be utilized as part of a sandwich structure which includes at least two other belts and/or fabrics. These additional belts include a high tension belt and a dewatering belt. The sandwich structure is subjected to pressure and tension over an extended nip formed by a rotating roll or static support surface. The extended nip can have an angle of wrap of between approximately 30 degrees and approximately 180 degrees, and is preferably between approximately 50 degrees and approximately 130 degrees. The nip length can be between approximately 800 mm and approximately 2500 mm, and is preferably between approximately 1200 mm and approximately 1500 mm. The nip can be formed by a rotating suction roll having a diameter that is between approximately 1000 mm and approximately 2500 mm, and is preferably between approximately 1400 mm and approximately 1700 mm.

As explained above, the structured fabric imparts a topographical pattern into the paper sheet or web. To accomplish this, high pressures can be imparted to the fabric via a high tension belt. The topography of the sheet pattern can be manipulated by varying the specifications of the fabric, i.e., by regulating parameters such as, yarn diameter, yarn shape, yarn density, and yarn type. Different topographical patterns can be imparted in the sheet by different surface weaves. Similarly, the intensity of the sheet pattern can be varied by altering the pressure imparted by the high tension belt and by varying the specification of the fabric. Other factors which can influence the nature and intensity of the topographical pattern of the sheet include air temperature, air speed, air pressure, belt dwell time in the extended nip, and nip length.

The following are non-limiting characteristics and/or properties of the structured fabric: to enable suitable dewatering, the single or multi-layered fabric should have a permeability value of between approximately 100 cfm and approximately 1200 cfm, and is preferably between approximately 200 cfm and approximately 900 cfm; the fabric which is part of a sandwich structure with two other belts, e.g., a high tension belt and a dewatering belt, is subjected to pressure and tension over a rotating or static support surface and at an angle of wrap of between approximately 30 degrees and approximately 180 degrees and preferably between approximately 50 degrees and approximately 130 degrees; the fabric should have a paper surface contact area of between approximately 5% and approximately 70% when not under pressure or tension; the forming fabric should have an open area of between approximately 10% and approximately 90%.

The fabric is preferably a woven fabric that can be installed on an ATMOS machine as a pre-joined and/or seamed continuous and/or endless belt. Alternatively, the forming fabric can be joined in the ATMOS machine using e.g., a pin-seam arrangement or can otherwise be seamed on the machine. In order to resist the high moisture and heat generated by the ATMOS papermaking process, the woven single or multi-layered fabric may utilize either hydrolysis and/or heat resistant materials. Hydrolysis resistant materials should preferably include a PET monofilament having an intrinsic viscosity value normally associated with dryer and TAD fabrics in the range of between 0.72 IV (Intrinsic Velocity, i.e., a dimensionless number used to correlate the molecular weight of a polymer. The higher the number the higher the molecular weight) and approximately 1.0 IV and also have a suitable "stabilization package" which including carboxyl end group equivalents, as the acid groups catalyze hydrolysis and residual DEG or di-ethylene glycol as this too can increase the rate of hydrolysis. These two factors separate the resin which can be used from the typical PET bottle resin. For hydrolysis, it has been found that the carboxyl equivalent should be as low as possible to begin with, and should be less than approximately 12. The DEG level should be less than approximately 0.75%. Even at this low level of carboxyl end groups it is essential that an end capping agent be added, and should utilize a carbodiimide during extrusion to ensure that at the end of the process there are no free carboxyl groups. There are several classes of chemical than can be used to cap the end groups such as epoxies, ortho-esters, and isocyanates, but in practice monomeric and combinations of monomeric with polymeric carbodiimindes are the best and most used.

Heat resistant materials such as PPS can be utilized in the structured fabric. Other materials such as PEN, PBT, PEEK and PA can also be used to improve properties of the fabric such as stability, cleanliness and life. Both single polymer yarns and copolymer yarns can be used. The material for the fabric need not necessarily be made from monofilament and can be a multi-filament, core and sheath, and could also be a non-plastic material, i.e., a metallic material. Similarly, the fabric may not necessarily be made of a single material and can be made of two, three or more different materials. The use of shaped yarns, i.e., non-circular yarns, can also be utilized to enhance or control the topography or properties of the paper sheet. Shaped yarns can also be utilized to improve or control fabric characteristics or properties such as stability, caliper, surface contact area, surface planarity, permeability and wearability.

The structured fabric can also be treated and/or coated with an additional polymeric material that is applied by e.g., deposition. The material can be added cross-linked during processing in order to enhance fabric stability, contamination resistance, drainage, wearability, improve heat and/or hydrolysis resistance and in order to reduce fabric surface tension. This aids in sheet release and/or reduce drive loads. The treatment/coating can be applied to impart/improve one or several of these properties of the fabric. As indicated previously, the topographical pattern in the paper web can be changed and manipulated by use of different single and multi-layer weaves. Further enhancement of the pattern can be further attained by adjustments to the specific fabric weave by changes to the yarn diameter, yarn counts, yarn types, yarn shapes, permeability, caliper and the addition of a treatment or coating etc. Finally, one or more surfaces of the fabric or molding belt can be subjected to sanding and/or abrading in order to enhance surface characteristics.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the mesh of the papermaking surface. In a typical embodiment of the fabrics disclosed herein, preferably the diameter of the warp and weft yarns can be between about 0.10 and 0.50 mm. The diameter of the warp yarns can be about 0.45 mm, is preferably about 0.27 mm, and is most preferably about 0.35 mm. The diameter of the weft yarns can be about 0.50 mm, is preferably about 0.35 mm, and is most preferably about 0.42 mm. Those of skill in the art will appreciate that yarns having diameters outside the above ranges may be used in certain applications. In one embodiment of the present invention, the warp and weft yarns can have diameters of between about 0.13 mm, and 0.17 mm. Fabrics employing these yarn sizes may be implemented with polyester yarns or with a combination of polyester and nylon yarns.

It is noted that the foregoing examples have been provided merely for the purpose of explanation and are in no way to be construed as limiting of the present invention. While the present invention has been described with reference to exemplary embodiments, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular arrangements, materials and embodiments, the invention is not intended to be limited to the particulars disclosed herein. Instead, the invention extends to all functionally equivalent structures, methods and uses, such as are within the scope of the appended claims.

What is claimed:

1. A forming fabric for making a bulky web, comprising:
a machine facing side; and
a web facing side comprising pockets formed by warp and weft yarns,
wherein the pockets are defined by more than four sides on an upper plane of the web facing side and by plural weft knuckles and plural warp knuckles, and
wherein each pocket has a bottom formed by a different number of weft and warp yarns.

2. The fabric of claim 1, wherein the bulky web comprises at least one of a tissue web, a hygiene web, and a towel web.

3. The fabric of claim 1, wherein the pockets are substantially equally sized pockets.

4. The fabric of claim 1, wherein a bottom of the pockets are formed by a plain weave of the warp and weft yarns.

5. The fabric of claim 1, wherein a shape of the pockets is at least one of
non square-shaped;
non rectangular-shaped; and
six-sided.

6. The fabric of claim 1, wherein the different number of the warp and the weft yarns comprises more weft yarns than warp yarns.

7. The fabric of claim 1, wherein the fabric comprises a warp mesh of about 59, a weft count of about 48, a permeability of approximately 573 cfm, and a caliper of approximately 0.0362 inches.

8. The fabric of claim 1, wherein the fabric comprises at least one of:
a single material;
a monofilament material;
a multifilament material; and
two or more different materials.

9. The fabric of claim 1, wherein the fabric is resistant to at least one of hydrolysis and temperatures which exceed 100 degrees C.

10. The fabric of claim 1, wherein the fabric is an endless belt that is at least one of pre-seamed and has its ends joined on a machine which utilizes a belt press.

11. The fabric of claim 1, wherein the fabric is structured and arranged to impart a topographical pattern to a web.

12. The fabric of claim 1, wherein the fabric utilizes a pattern repeat of ten warp yarns and ten weft yarns.

13. The fabric of claim 12, wherein none of the warp yarns of the pattern repeat plainly weaves with all ten weft yarns.

14. A method of subjecting a web to pressing in a paper machine using the fabric of claim 1, the method comprising:
forming a web; and
applying pressure to the fabric and the web.

15. The method of claim 14, wherein the paper machine comprises one of:
a TAD system;
an ATMOS system;
an E-TAD system; and
a Metso system.

16. The fabric of claim 1, wherein the plural warp knuckles are each formed by a warp yarn passing over at least three well yarns and wherein the plural well knuckles are each formed by a well yarn passing over at least two warp yarns.

17. The fabric of claim 1, wherein the plural warp knuckles are longer than the plural well knuckles.

18. The fabric of claim 1, wherein the plural warp knuckles and the plural weft knuckles form different length impressions.

19. A forming fabric for making a bulky web, comprising:
a machine facing side; and
a web facing side comprising pockets formed by warp and weft yarns,
wherein the pockets are defined by more than four sides on an upper plane of the web facing side,
wherein the fabric utilizes a pattern repeat of ten warp yarns and ten weft yarns, and
wherein three of the warp yarns of the pattern repeat floats over five weft yarns.

20. A forming fabric for making a bulky web, comprising:
a machine facing side; and
a web facing side comprising pockets formed by warp and weft yarns,
wherein the pockets are defined by more than four sides on an upper plane of the web facing side,
wherein the fabric utilizes a pattern repeat of ten warp yarns and ten weft yarns, and
wherein one of the warp yarns of the pattern repeat floats over weft yarns 4-8 and another of the warp yarns floats over weft yarns 2-6 or 6-10.

21. A forming fabric for making a bulky web, comprising:
a machine facing side; and
a web facing side comprising pockets formed by warp and weft yarns,
wherein the pockets are defined by more than four sides on an upper plane of the web facing side,
wherein the fabric utilizes a pattern repeat of ten warp yarns and ten weft yarns, and
wherein warp yarns 2, 4, 6, 8 and 10 of the pattern repeat passes over five weft yarns.

22. A forming fabric for making a bulky web, comprising:
a machine facing side; and
a web facing side comprising pockets formed by warp and weft yarns,
wherein the pockets are defined by more than four sides on an upper plane of the web facing side,
wherein the fabric utilizes a pattern repeat of ten warp yarns and ten weft yarns, and
wherein warp yarns 1, 3, 5, 7 and 9 of the pattern repeat passes over six weft yarns.

23. A forming fabric for making a bulky web, comprising:
a web facing side comprises pockets formed by warp and weft yarns;
a bottom of the pockets is formed a plain weave of the warp and weft yarns; and
a contact plane of the web facing side comprises warp knuckles and weft knuckles,
wherein the pockets are defined by more than four sides on the contact plane of the web facing side and by plural weft knuckles and plural warp knuckles, and
wherein the bottom of each pocket is formed by a different number of weft and warp yarns.

24. A forming fabric for making a bulky web, comprising:
a web facing side comprises pockets formed by warp and weft yarns;
a bottom of the pockets is formed a plain weave of the warp and weft yarns; and
a contact plane of the web facing side comprises warp knuckles,
wherein the pockets are defined by more than four sides on the contact plane of the web facing side, and
wherein a bottom of the pockets comprises a different number of the warp and the weft yarns.

25. The fabric of claim 24, wherein the different number of the warp and the weft yarns comprises three warp yarns and more than three weft yarns.

26. A forming fabric for making a bulky web, comprising:
a web facing side comprises pockets formed by warp and weft yarns;
a bottom of the pockets is formed a plain weave of the warp and weft yarns; and
a contact plane of the web facing side comprises warp and weft knuckles forming different length impressions,
wherein the pockets are defined by more than four sides on the upper plane of the web facing side and by plural well knuckles and plural warp knuckles, and
wherein the bottom of each pocket is formed by a different number of well and warp yarns.

27. A forming fabric for making a bulky web, comprising:
a web facing side comprises pockets formed by warp and well yarns;
a bottom of the pockets is formed a plain weave of the warp and weft yarns; and
a contact plane of the web facing side comprises warp and weft knuckles,
wherein the pockets are defined by more than four sides on the upper plane of the web facing side, and
wherein each pocket is formed by less warp yarns than well yarns.

28. A forming fabric for making a bulky web, comprising:
a web facing side comprises pockets formed by warp and weft yarns;
a bottom of the pockets is formed a plain weave of the warp and weft yarns; and
a contact plane of the web facing side comprises warp and well knuckles,
wherein the pockets are defined by more than four sides on the upper plane of the web facing side, and
wherein each pocket is formed by five warp yarns and seven weft yarns.

29. A paper making machine fabric comprising:
a woven fabric having a weave pattern which is regularly repeated over a surface;
weft yarns, warp yarns, and recesses or pockets which open upwardly to a paper supporting side of the fabric, wherein in zones spaced over the surface of the fabric;
at least one of the warp yarns overlays five of the weft yarns in direct sequence; and
at least one of the weft yarns overlays four of the warp yarns in direct sequence,
wherein the recesses or pockets are defined on the paper supporting side by plural weft knuckles and plural warp knuckles, and
wherein a bottom of each recess or pocket is formed by a different number of weft and warp yarns.

30. A paper making machine fabric comprising:
a woven fabric having a weave pattern repeating over a surface;
a pattern square for the repeating pattern containing ten warp yarns and ten weft yarns;
warp yarn 1 extending over weft yarn 1, under weft yarns 2-3, over weft yarns 4-8 and under weft yarns 9-10;
warp yarn 2 extending under weft yarn 1, over well yarn 2, under weft yarn 3, over weft yarn 4, under weft yarn 5, over weft yarn 6, under well yarns 7-8 and over weft yarns 9-10;
warp yarn 3 extending over well yarns 1-2, under weft yarns 3-4, over well yarn 5, under well yarns 6-7 and over weft yarns 8-10;
warp yarn 4 extending under weft yarns 1-2, over weft yarns 3-4, under weft yarn 5, over weft yarn 6, under well yarn 7, over well yarn 8, under well yarn 9 and over well yarn 10;
warp yarn 5 extending under well yarn 1, over well yarns 2-6, under weft yarns 7-8, over weft yarn 9 and under well yarn 10;
warp yarn 6 extending under weft yarn 1, over weft yarn 2, under weft yarn 3, over well yarn 4, under well yarns 5-6, over weft yarns 7-8, under weft yarn 9 and over well yarn 10;
warp yarn 7 extending under weft yarns 1-2, over well yarn 3, under well yarns 4-5 and over weft yarns 6-10;
warp yarn 8 extending over weft yarns 1-2, under weft yarn 3, over weft yarn 4, under well yarn 5, over well yarn 6, under weft yarn 7, over weft yarn 8 and under weft yarns 9-10;
warp yarn 9 extending over weft yarns 1-4, under weft yarns 5-6, over weft yarn 7, under weft yarns 8-9 and over weft yarn 10; and
warp yarn 10 extending under weft yarn 1, over well yarn 2, under well yarns 3-4, over well yarns 5-6, under weft yarn 7, over well yarn 8, under weft yarn 9 and over weft yarn 10.

* * * * *